US005469643A

United States Patent [19]

Forrest

[11] Patent Number: 5,469,643

[45] Date of Patent: Nov. 28, 1995

[54] SNOWSHOE

[75] Inventor: William E. Forrest, Denver, Colo.

[73] Assignee: Mountain Safety Research, Seattle, Wash.

[21] Appl. No.: 141,853

[22] Filed: Oct. 22, 1993

[51] Int. Cl.[6] ..... A43B 5/04; A63C 13/00

[52] U.S. Cl. ..... 36/122; 36/124

[58] Field of Search ..... 36/122, 123, 124, 36/125, 116

[56] References Cited

U.S. PATENT DOCUMENTS

| | | | |
|---|---|---|---|
| 1,004,900 | 10/1911 | Pease . | |
| 2,511,087 | 6/1950 | Villemin | 36/122 |
| 3,299,541 | 1/1967 | Snyder | 36/4.5 |
| 3,600,829 | 8/1971 | LaViolette | 36/4.5 |
| 3,638,333 | 2/1972 | Sprandel | 36/4.5 |
| 3,861,698 | 1/1975 | Greig | 36/122 |
| 4,271,609 | 6/1981 | Merrifield | 36/125 |
| 4,348,823 | 9/1982 | Knapp et al. | 36/123 |
| 4,351,121 | 9/1982 | Wallace | 36/125 |
| 5,014,450 | 5/1991 | McGrath | 36/124 |
| 5,253,437 | 10/1993 | Klebahn et al. | 36/122 |
| 5,259,128 | 11/1993 | Howell | 36/122 |

OTHER PUBLICATIONS

Osgood et al., *The Snowshoe Book, Third Edition,* 1985, pp. 1–149.

*Primary Examiner*—Steven N. Meyers
*Attorney, Agent, or Firm*—Sheridan Ross & McIntosh

[57] ABSTRACT

A snowshoe (10) which provides improved sideslip protection, forward tracking guidance and overall stability is provided. The snowshoe (10) includes a convex flotation plate (12), side bars (14 and 16), a crampon (18) and a binding (20). The side bars (14 and 16) provide sideslip protection and rigidity which makes it possible to construct the flotation plate (12) from lightweight semi-rigid or somewhat flexible material. Channels (34, 36 and 38) are formed in a rear portion (40) of snowshoe (10) which, together with the convex flotation plate (12) and side bars (14 and 16), enhance forward tracking guidance as well as provide additional rigidity to the somewhat flexible flotation plate (12). The binding (20) includes straps (90, 92 and 94) and a one piece fabric foot wrap (96).

10 Claims, 5 Drawing Sheets

SNOWSHOE

FIELD OF THE INVENTION

The present invention relates generally to snowshoeing and, in particular, to a novel snowshoe which provides improved sideslip protection, forward tracking guidance and overall stability and lightweight material options.

BACKGROUND OF THE INVENTION

According to some historians, the first snowshoes were developed about 6,000 years ago in Central Asia. Snowshoes have been used in North America for many centuries, first by native American peoples and later by trappers, explorers and other European settlers. Traditionally, snowshoes were formed from light oval or teardrop shaped wooden frames strung with thongs made from animal hide. The resulting snowshoe could then be strapped to a person's foot, i.e., directly or via footgear, so as to enable the person to walk in soft snow without sinking too deeply.

Today, snowshoes are most commonly used for recreation and by mountaineers to facilitate winter access to remote backcountry locations. Although the materials and production techniques have changed, modern snowshoes have much in common with traditional snowshoes developed over the centuries. FIG. 1 illustrates some features of one type of snowshoe 1 in common use today. The general shape of the snowshoe 1 is defined by a tubular perimeter structure 2 which is ordinarily formed from aluminum. The requisite flotation surface area is typically provided by webbing or a platform 3, formed from animal hide or synthetic materials, which is connected to the tubular perimeter structure 2 via sturdy lacing 4 or rivets. The snowshoe 1 is attached to the wearer's foot via footgear 5 using a toestrap 6, and an additional heel strap 7 is usually provided. Often, a hinged metal device or so-called crampon 8 which extends through an opening 9 in platform 3 is provided to improve forward traction on hills or ice.

Despite the long evolution of the snowshoe art, current snowshoes are subject to certain limitations. For example, when the snowshoer traverses a steep hill, current snowshoes are highly susceptible to side slippage. In addition to being a source of annoyance, such sideslipping can be a matter of grave safety concern for the backcountry mountaineer. Current snowshoes as described above are also subject to a certain instability relating to snow compaction. In particular, as the snowshoer places weight on the snowshoe, the platform tends to flex to a concave shape. As a result, snow may be forced towards the snowshoe perimeter rather than providing stable support under the snowshoer's foot. Additionally, current snowshoes tend to create resistance to the shuffling movement entailed in forward snowshoeing. In this regard, the tubular perimeter and angled orientation of common snowshoe perimeter structures result in snow plowing when the snowshoe is shuffled in a forward direction. Moreover, current snowshoes generally do not facilitate forward tracking, i.e., even on flat ground, current snowshoes can easily drift transversely to the desired direction of travel during shuffling.

The snowshoe binding has also presented persistent challenges for snowshoe designers as many desired binding qualities seemingly demand incompatible design features. For example, the binding must be able to securely accommodate a variety of footgear sizes and styles in order to be suitable for general use. However, in order to facilitate proper snowshoeing motion and reduce strain on the snowshoer, the binding must provide excellent lateral foot stability, limit vertical movement of the snowshoer's footgear, and limit forward or rearward slipping of the footgear as may occur in hilly terrain. In addition, it is highly desirable to provide a binding which can be quickly and easily attached and detached even though the snowshoer's finger dexterity may be limited due to coldness or handgear. Furthermore, it would be advantageous to provide a binding which affords some degree of protection against wetness, which is of simple construction and which can be produced inexpensively.

Accordingly, there is a need for an improved snowshoe which addresses the limitations and challenges facing snowshoe designers.

SUMMARY OF THE INVENTION

The snowshoe of the present invention is designed to provide improved protection against sideslipping, forward tracking guidance and overall stability and reduced weight. In addition, the present invention includes a binding which is easy to construct and use, yet is capable of securely and stably engaging a variety of footgear and footgear sizes.

According to one aspect of the present invention, a snowshoe includes a flotation plate and a pair of side bars projecting downwardly from the flotation plate's lower snow contact surface. The flotation plate is preferably formed from a lightweight and semi-rigid or somewhat flexible material such as thermal formed plastic. The side bars, which can be formed as an integral portion of the flotation plate or formed as separate pieces for attachment to the flotation plate, are laterally spaced for stability. Preferably, the spacing of the side bars is at least equal to the width of a snowshoer's foot and is less than the maximum flotation plate width. In one embodiment, the flotation plate has an opening through which a crampon and a forward portion of the snowshoer's foot can project, and the side bars are positioned adjacent the side edges of the opening. The side bars extend substantially linearly along the length of the flotation plate and preferably have narrow bottom and frontal profiles. In addition, the side bars have a length which is at least about equal to the length of the snowshoer's foot.

The side bars provide a number of advantages relative to conventional snowshoes. First, the side bars penetrate into the snow during use and thereby afford positive protection against sideslipping. The side bars therefore provide for greater safety when traversing steep terrain. The side bars also impart improved torsional rigidity to the flotation plate so that the material requirements of the flotation plate can be reduced and a lighter weight snowshoe can be achieved. Moreover, the crampon can be connected to the side bars thereby shortening the crampon connection and reducing strain on the connection assembly. The side bars also penetrate the snow during shuffling movement substantially without plowing and contribute to forward tracking guidance.

According to another aspect of the invention, a snowshoe includes a semi-rigid flotation plate which has at least one recessed channel formed in its lower, snow contact surface. In one embodiment, three channels are provided. The channels extend longitudinally along a rear portion to a rear edge of the snowshoe so that, during forward travel, snow travels through the channels and exits the channels at the rear edge. The channels thereby enhance forward tracking guidance.

According to yet another aspect of the present invention, a snowshoe includes a semi-rigid flotation plate having a convex lower, snow contact surface. The convex snow contact surface is formed such that the side edges of the snow contact surface are lower than an intervening central portion of the surface. In this manner, snow is urged towards the center of the snow contact surface as the snowshoer places weight on the snowshoe so that the snow is compacted to form a stable platform beneath the snowshoer's foot. Additionally, the convex snow contact surface further contributes to forward tracking guidance during shuffling. In this regard, it will be appreciated that snow is funneled through the arched space formed by the convex lower surface during forward motion.

According to a still further aspect of the present invention, a binding for use in attaching a device, e.g., a snow transportation device such as a snowshoe or cross-country ski, to a wearer's foot, directly or via footgear, is provided. The binding includes a toe strap for engaging a toe portion of the wearer's foot, a heel strap for engaging a heel portion of the wearer's foot, and a foot wrap for wrapping about sections of the foot. The foot wrap is preferably formed from flexible material which is resistant to cold cracking. The foot wrap includes a base portion underlying the ball of the wearer's foot, a toe flap portion extending around the front edge and over the toe of the wearer's foot, and side portions extending around the side of the wearer's foot from the ball to the instep sections of the wearer's foot. The binding further includes attachment structures for interconnecting the toe strap to the side portions and toe flap portion of the foot wrap and for interconnecting the heel strap to the side portions of the foot wrap. For example, the attachment structures can include wing portions extending from the foot wrap and/or stitching, rivets or other fasteners. The binding can further include an instep strap and an attachment structure for interconnecting the instep strap to the side portions of the foot wrap. The binding can thus accommodate footgear of various sizes and styles, restrict vertical and horizontal movement of the footgear, and provide excellent lateral stability. In addition, the foot wrap can be formed using a single die cut for ease of construction.

BRIEF DESCRIPTION OF THE DRAWINGS

Additional features and corresponding advantages of the present invention will be appreciated upon consideration of the Detailed Description below, taken in conjunction with the drawings in which.

DETAILED DESCRIPTION

Figure 1:
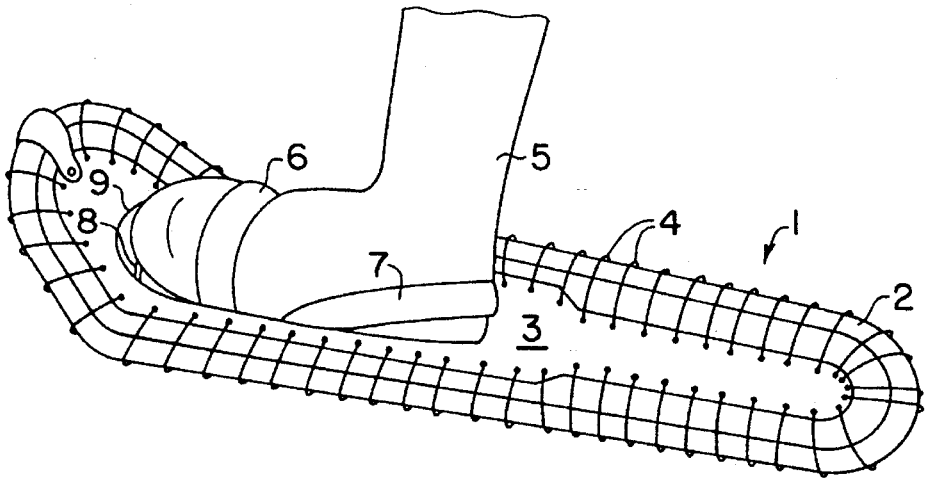
FIG. 1 PRIOR ART
FIG. 1, as described in the Background of the Invention, illustrates some features of one type of prior art snowshoe.
Figure 2:
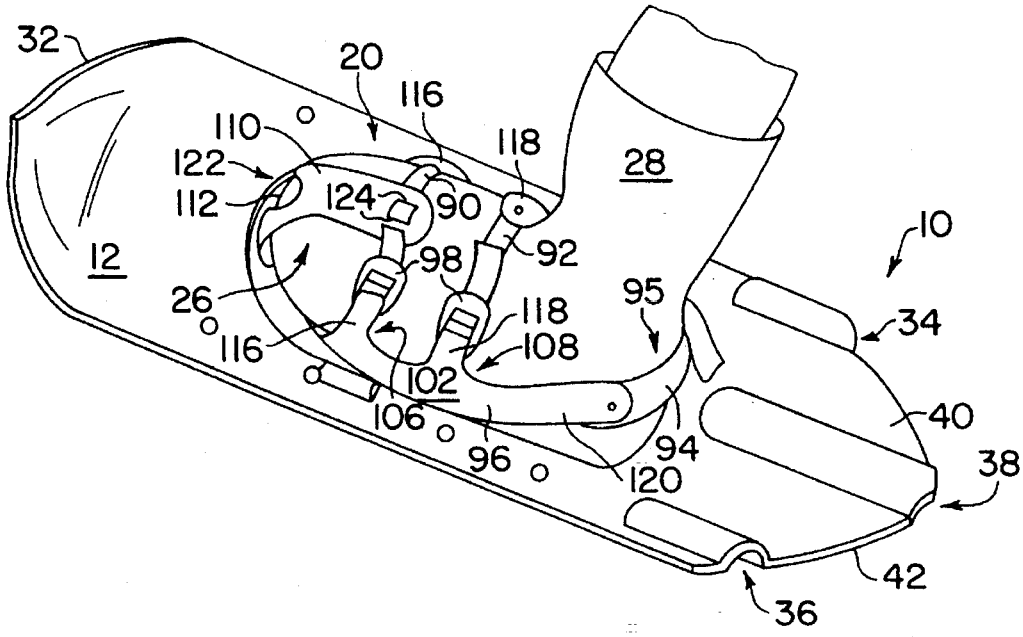
FIG. 2 is a perspective view of a snowshoe constructed in accordance with the present invention.
Figure 3:
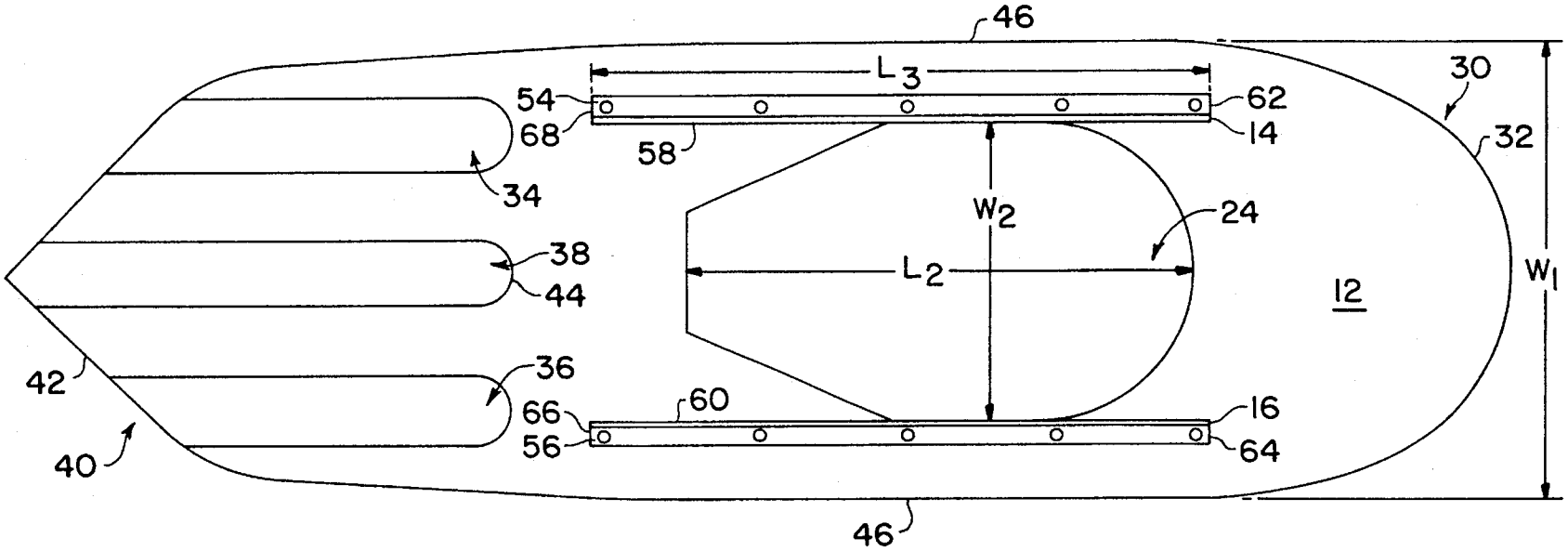
FIG. 3 is a bottom view showing the flotation plate and side bars of the snowshoe of FIG. 1.
Figure 4:
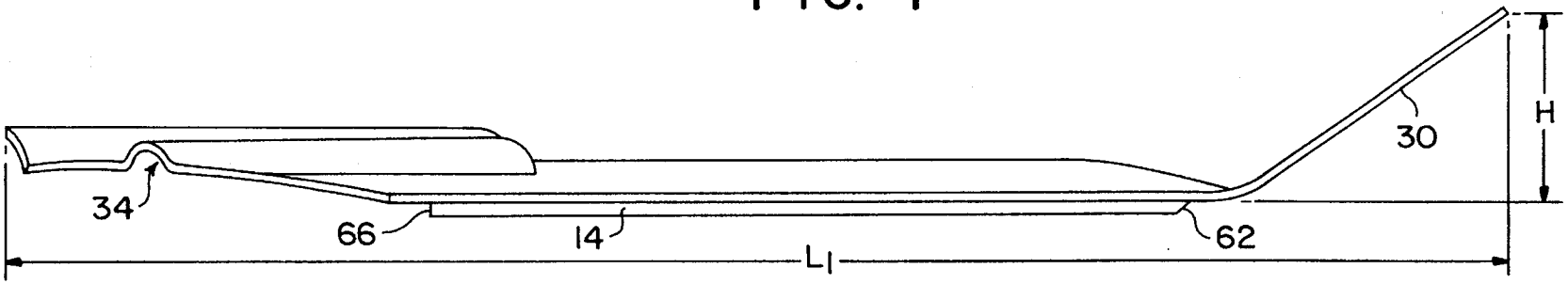
FIG. 4 is a side view of the flotation plate and side bars of the snowshoe of FIG. 1.

Referring to FIGS. 2–8, a snowshoe constructed in accordance with the present invention is generally identified by the reference numeral 10. Generally, the snowshoe 10 comprises a flotation plate 12, side bars 14 and 16, a crampon 18 and a binding 20. In the illustrated embodiment, the binding is designed for attachment to a snowshoer's footgear 28.

The flotation plate 12 can be formed from any of various lightweight semi-rigid materials such as various and plastics. The illustrated flotation plate 12 is formed from 3/16 or 1/8 inch thick thermal formed, high density polyethylene which provides adequate strength and rigidity and allows for simple and inexpensive construction. The overall dimensions of the flotation plate 12 can be varied depending on the weight or skill of the snowshoer, the size of the snowshoer's footgear 28, local snow conditions, the load being carried or other factors. In this regard, the snowshoe 10 can be provided, for example, in various lengths (e.g., 22 inches, 26 inches or 30 inches) and widths (e.g., 8 inches or 9 inches) to accommodate a range of conditions. The illustrated flotation plate 12 has a length $L_1$ of about 26 inches and a width $W_1$ of about 8 inches.

The shape of the flotation plate 12 is further defined by a number of molded curves and channels and a central cut-out 24. The cut-out 24 is provided to allow the crampon 18 and a toe section 26 of the snowshoer's footgear 28 to extend through the flotation plate 12 for improved traction. The illustrated cut-out 24 has a length $L_2$ of about 8.75 inches and a width $W_2$ of about 5.25 inches. The flotation plate 12 can also be provided with perforations (not shown) to minimize snowshoe weight.

In order to facilitate forward shuffling of the snowshoe 10 through snow, the tip portion 30 of the flotation plate 12 adjacent leading edge 32 is curved upwardly. The upward curve begins just forward of the cutout 24, about 5 inches from leading edge 32. The curve defines an approximately 36° angle relative to horizontal such that the forwardmost point of leading edge 32 is elevated to a height H of about 3.75 inches relative to the base of flotation plate 12. As will be better understood upon consideration of the description below, the upward curve is actually a compound curve resulting from the blending of the upward tip projection and the overall convex frontal profile of the flotation plate 12 as can be see in FIG. 5.

In the illustrated embodiment, the flotation plate 12 further includes a pair of side channels 34 and 36 and a central channel 38, each of which extends along a rear portion 40 of the flotation plate 12 to rear edge 42. The channels are formed as recesses into the underside of flotation plate 12. The illustrated central channel is about 1/2–3/4 inch wide, 1/2–3/4 inch deep and its front edge 44 is located about 5.5 inches rearwardly from cut-out 24. The side channels 34 and 36 are slightly smaller than the central channel 38, e.g., about 3/8–1/2 inch wide and 3/8–1/2 inch deep. During forward travel, snow passes through the channels 34, 36 and 38 and exits at the rear edge 42 of the snowshoe 10 such that the channels 34, 36 and 38 enhance forward tracking guidance. These channels 34, 36 and 38 also add rigidity to the rear portion 40 of the flotation plate 12.

In an alternative embodiment (not shown), the side channels are eliminated, the side bars extend further towards the rear edge of the flotation plate and the central channel is enlarged. In addition, the central channel has a tapered profile which extends upwardly relative to the flotation plate such that the snowshoer's footgear is urged forwardly due to the taper inclination.

Figure 5:
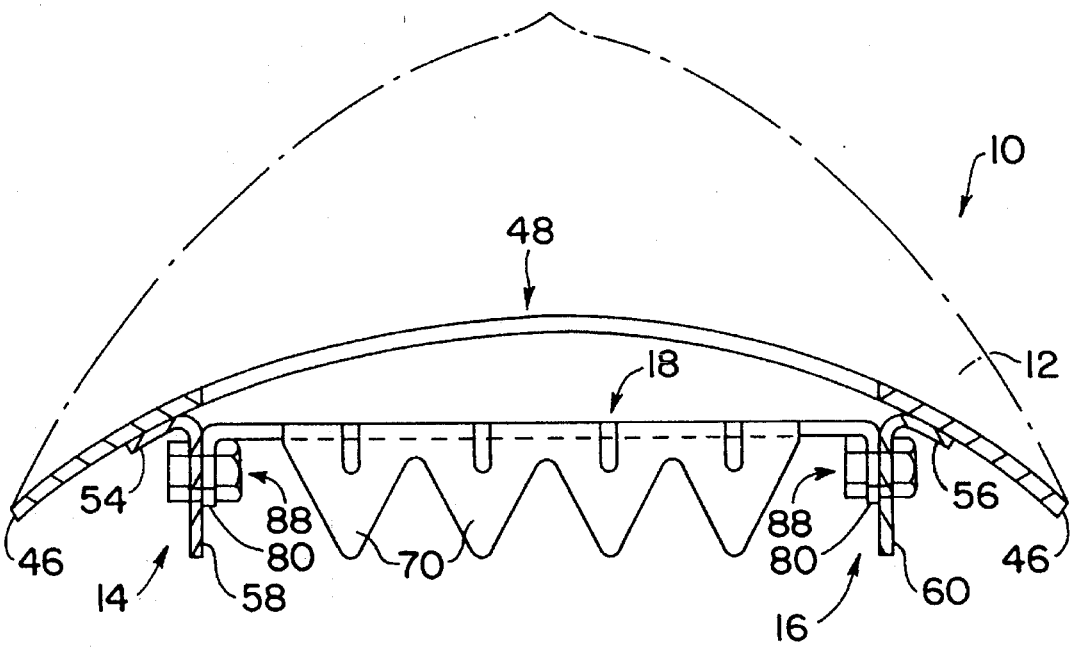
FIG. 5 is a cut-away front view of the flotation plate, side bars and crampon of the snowshoe of FIG. 1.
Figure 7:
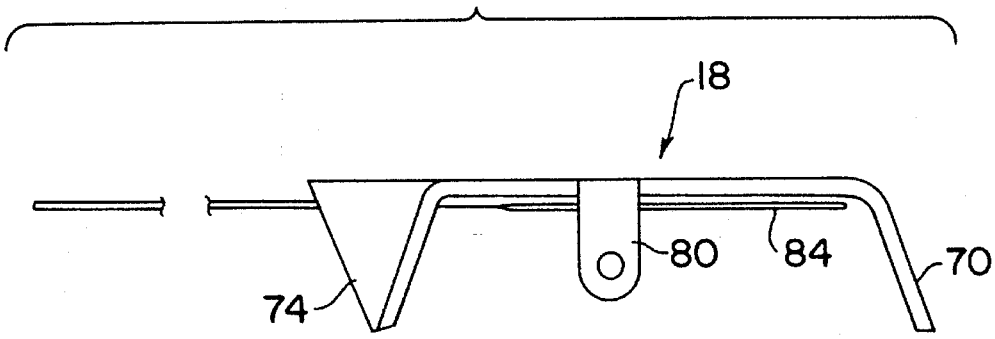
FIG. 7 is a side view of the crampon of the snowshoe of FIG. 1.

As can be most clearly seen in FIG. 5, the flotation plate 12 has a convex frontal profile such that the side edges 46 are positioned lower than a central portion 48 of the flotation plate 12. In the illustrated embodiment, this concavity is defined by a radius of curvature of about 12 inches. When the snowshoer places weight on the snowshoe 10 thereby forcing the flotation plate 12 downwardly into the snow, the convex frontal profile causes snow to gather or move towards the center of the flotation plate 12 so that a stable snow platform is provided beneath the snowshoer's foot. In addition, as the snowshoer shuffles forwardly, the convex flotation plate 12 forms a snow ridge which further assists in forward tracking guidance.

The snowshoe 10 further includes a pair of side bars 14 and 16 which project downwardly from flotation plate 12. The side bars 14 and 16 can be molded into flotation plate 12 or formed separately for attachment to flotation plate 12. The illustrated side bars 14 and 16 are formed from 3/32 inch thick aluminum and are attached to flotation plate 12 via rivets, screws or other fasteners extending through side bar flanges 54 and 56 into flotation plate 12. The side bars 14 and 16 thereby have narrow frontal and bottom profiles which facilitate snow penetration. The angle between each of the flanges 54 and 56 and the corresponding downward projections 58 and 60 of side bars 14 and 16 is formed such that the projections 58 and 60 extend substantially vertically downward when the flanges 54 and 56 are attached to the convex lower surface of flotation plate 12.

The side bars 14 and 16 preferably have a length $L_3$ which is at least about as great as the length of the snowshoer's footgear 28. In this regard, the illustrated side bars 14 and 16 are about 12 inches long and are positioned such that the front edges 62 and 64 thereof are about ½ inch forward from cut-out 24. The side bars extend substantially linearly from the front edges 62 and 64 to the rear edges 66 and 68 thereof and are oriented parallel to the direction of forward travel so that substantially no snow plowing occurs during shuffling. In addition, the front edges 62 and 64 in the illustrated embodiment are beveled to further facilitate snow penetration and to allow the side bars 14 and 16 to smoothly ride up over obstructions.

The depth of the downward projections 58 and 60 is selected such that the side bars 14 and 16 provide protection against side slipping of the snowshoe 10 and also allow for extension of the crampon 18 below the side bars 14 and 16 for improved forward traction on hills or ice or braking when descending same. Furthermore, the depth of the side bars 14 and 16 is preferably about equal to the depth of the crampon claws when the crampon 18 is in a level orientation. The illustrated side bars 14 and 16 extend downwardly about 0.9 inch from flotation plate 12. If desired, the side bars 14 and 16 can be serrated for additional traction. In addition to protecting against side slipping, it will be appreciated that the illustrated side bars 14 and 16 further enhance forward tracking guidance and impart longitudinal torsional rigidity to the snowshoe 10 and allow the use of somewhat flexible materials in the flotation plate 12.

Figure 6:
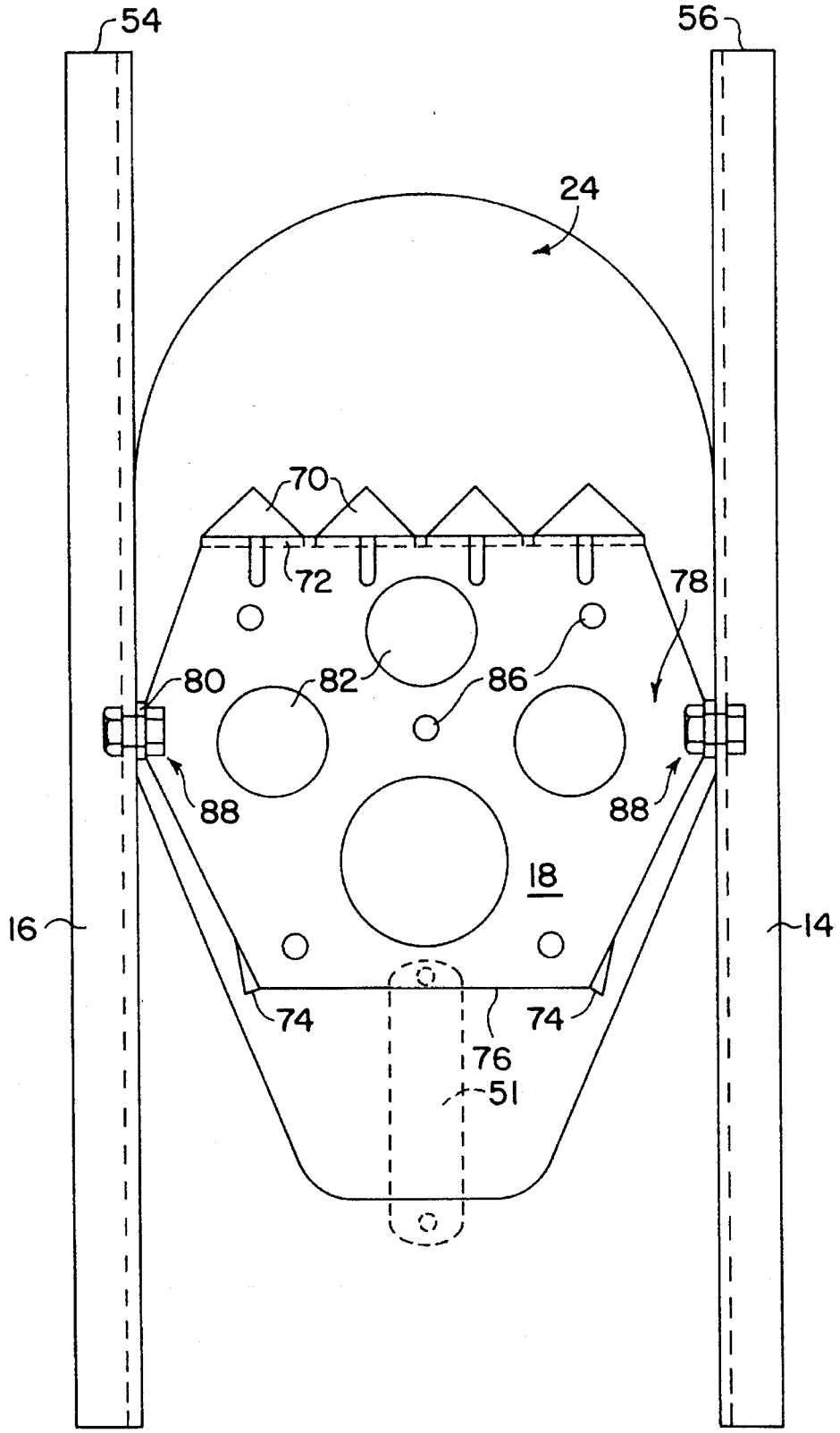
FIG. 6 is a bottom view showing the interconnection between the crampon and side bars of the snowshoe of FIG. 1.

As shown most clearly in FIGS. 5–6, the side bars 14 and 16 are spaced across the width of the snowshoe 10. Preferably, the side bars 14 and 16 are spaced by a distance at least about as great as the width of the snowshoer's footgear 28. In the illustrated embodiment, the side bars 14 and 16 are positioned adjacent the sides of cut-out 24 with the flanges 54 and 56 projecting outwardly. This positioning allows the crampon 18 to be attached to the side bars 14 and 16 such that the crampon connection is short and stress on the connection is minimal as it is substantially totally in shear. The illustrated crampon 18 is connected directly to the side bars 14 and 16 using pins 88 which allow for pivoting of the crampon 18 with the snowshoer's footgear 28.

The crampon 18, which can be formed from plate steel or aluminum, includes a number of front claws 70 at its front edge 72 and a number of rear claws 74 at its rear edge 76 for traction. The front claws 70 and rear claws 76 each define an approximately 95° angle relative to the crampon base. In addition, the crampon includes a widened portion 78 provided with downwardly projecting wings 80 for attachment to the side bars 14 and 16. The attachment pins 88 are positioned on snowshoe 10 such that more of the snowshoe weight is located rearwardly of the pins 88 so that the snowshoe tip portions 30 naturally rotate upwardly. To reduce weight, perforations 82 can be formed in crampon 18. Furthermore, in order to minimize icing of the crampon 18, the crampon 18 can be covered with a plastic material 84. The laminate 84 can be attached to the crampon base, for example, via rivets inserted through holes 86. If desired, a flexible strap 51 (shown in phantom in FIG. 6) may be used to interconnect the crampon 18 to flotation plate 12 so as to limit the pivoting range of the crampon 18.

The snowshoer's footgear 28 is attached to the snowshoe 10 by binding 20. The illustrated binding 20 includes a toe strap 90 which extends over a toe section 26 of footgear 28, an instep strap 92 which extends over an instep section 108 of footgear 28, a heel strap 94 which extends around heel section 95 of footgear 28 and foot wrap 96 which wraps about portions of footgear 28. Each of the straps 90, 92 and 94 is provided with an adjustable buckle 98 to allow for convenient and quick tightening of the straps 90, 92 and 94 by simply pulling on the strap ends. The foot wrap 96, which is preferably formed from a strong, flexible water repellent material, is attached to the crampon 18 using fasteners such as rivets or stitching, which can be the same fasteners used to attach the material 84 to the crampon 18. In the illustrated embodiment, the foot wrap is formed from vinyl coated polyester to provide the desired strength, flexibility and waterproof properties and resistance to cold cracking.

Figure 8:
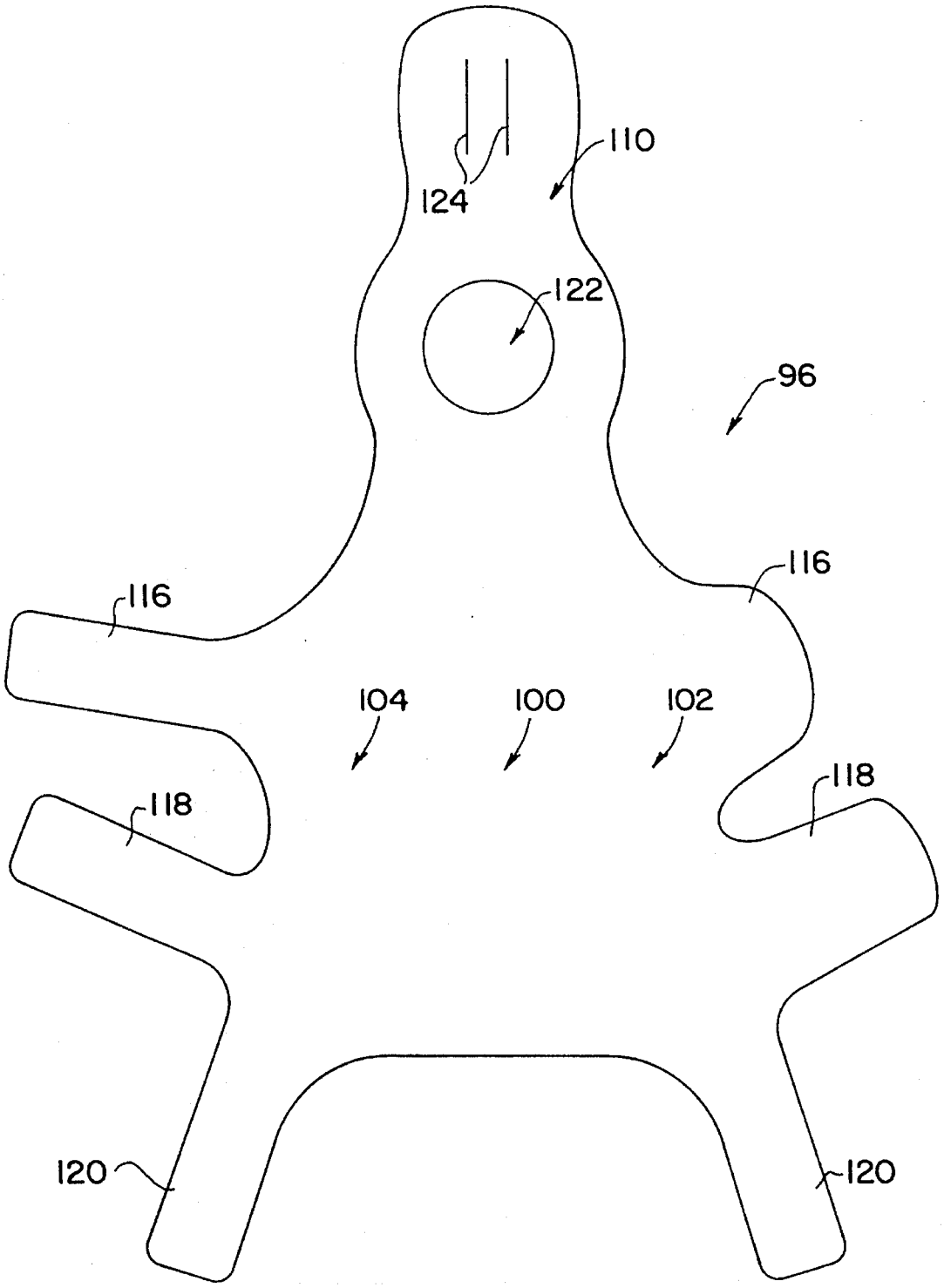
FIG. 8 is a top plan drawing showing the unfolded shape of the foot wrap of the snowshoe of FIG. 1.

FIG. 8 shows a top plan view of the unfolded foot wrap 96. The foot wrap 96 includes a base portion 100 for attachment to the crampon 18, right 102 and left 104 side portions which wrap around the footgear 28 from the ball section 106 to the instep section 108 thereof, and a toe flap portion 110 which extends around the front edge 112 and over the toe section 26 of the footgear 28. In addition, the foot wrap 96 includes toe wings 116, instep wings 118 and heel wings 120 for attachment to the respective toe strap 90, instep strap 92 and heel strap 94. The wings 116, 118 and 120 on one side of foot wrap 96 are attached to the straps 90, 92 and 94 by threading the wings 116, 118 and 120 through one side of the buckles 98, doubling the wings 116, 118 and 120 over on themselves, and stitching or otherwise attaching the wings 116, 118 and 120 to themselves or adjacent portions of the foot wrap 96. The straps 90, 92, and 94 are then threaded through the other side of the buckles 98 to complete the attachment. On the opposite side of foot wrap 96, the wings 116, 118 and 120 can be connected directly to the straps 90, 92 and 94.

The toe flap portion 110 is widened and includes an opening 122 at the area corresponding to the front edge 112 of footgear 28. This allows the toe flap portion 110 to flare around the front edge 112 of footgear 28 so as to securely engage the same and enhance both lateral and longitudinal stability. The toe flap portion 110 is further secured by threading the toe strap 90 through slits 124 in toe flap portion 110.

The illustrated binding 20 thus provides excellent lateral foot stability and securely limits both longitudinal and vertical footgear movement. In addition, the binding 20 accommodates footgear 28 of various sizes and styles and is easily and quickly attached to or detached from footgear 28. The binding 20 is also suitable for use on either the left or the right foot, thereby allowing for interchangeability of the snowshoe 10.

While various embodiments of the present invention have been described in detail, it is apparent that further modifications and adaptations of the invention will occur to those skilled in the art. However, it is to be expressly understood that such modifications and adaptations are within the spirit and scope of the present invention.

What is claimed is:

1. A snowshoe, comprising:

a) flotation means for providing a snow contact surface area, said flotation means having an upper surface and a lower surface, said lower surface including a tip portion adjacent a leading edge of said flotation means and a rear portion adjacent a rear edge of said flotation means, said lower surface of said flotation means having formed therein at least one recessed channel having a forward channel end located in said rear portion of said flotation means, said channel further having a narrow width in relation to a width of said flotation means and extending along said rear portion to said rear edge of said flotation means, wherein, during forward travel, snow passes through said channel and exits said channel at said rear edge; and b) binding means for use in attaching said snowshoe to said wearer's foot.

2. The snowshoe of claim 1, wherein said lower surface of said flotation means has a convex profile.

3. The snowshoe of claim 1, further comprising first and second side bars extending downwardly from said flotation means.

4. The snowshoe of claim 3, wherein said side bars are separated by a distance of at least about 5.25 inches.

5. The snowshoe of claim 3, wherein said side bars have a length of at least about 12 inches.

6. The snowshoe of claim 3, further comprising pivotable means for providing traction wherein said pivotable means includes attachment means for attachment to said first and second side bars.

7. The snowshoe of claim 3, further comprising pivotable means for providing traction having a width substantially equal to said transverse distance between said first and second side bars, wherein said pivotable means is attached to said first and second side bars.

8. The snowshoe of claim 7, wherein each of said first and second side bars comprises a first side bar portion for attachment to said flotation means and a second side bar portion extending downwardly from said first side bar portion, and each of said side bars is oriented such that said first side bar portion thereof is disposed adjacent said pivotable means.

9. The snowshoe of claim 1, wherein said binding means comprises a rigid platform pivotally interconnected to said flotation means and a flexible wrap including a bottom portion for interconnection to said rigid platform and a side portion extending upwardly from said bottom portion along a length of said rigid platform.

10. The snowshoe of claim 1, wherein said flotation means comprises a plate which defines an outermost periphery of said snowshoe.

* * * * *